United States Patent [19]

Simpson

[11] Patent Number: 4,927,297

[45] Date of Patent: May 22, 1990

[54] LEAK PREVENTION STRUCTURE, METHOD AND APPARATUS

[75] Inventor: William Simpson, Arlington Heights, Ill.

[73] Assignee: Clem Environmental Corporation, Chicago, Ill.

[21] Appl. No.: 253,238

[22] Filed: Oct. 4, 1988

[51] Int. Cl.[5] ..... E02D 3/12; C09K 17/00

[52] U.S. Cl. ..... 405/270; 405/267; 405/271; 405/258

[58] Field of Search ..... 405/267, 271, 269, 270

[56] References Cited

U.S. PATENT DOCUMENTS

| | | | |
|---|---|---|---|
| 3,186,896 | 5/1962 | Clem | 161/133 |
| 4,005,582 | 8/1975 | Tamaro | 61/35 |
| 4,048,373 | 10/1975 | Clem | 428/454 |
| 4,055,937 | 7/1976 | Tamaro | 52/577 |
| 4,056,154 | 7/1976 | Tamaro | 175/416 |
| 4,075,852 | 7/1976 | Tamaro | 61/35 |
| 4,103,499 | 5/1977 | Clem | 61/50 |
| 4,126,007 | 11/1978 | Mars | 405/271 |
| 4,139,588 | 3/1978 | Clem | 264/232 |
| 4,209,568 | 9/1975 | Clem | 428/454 |
| 4,226,557 | 10/1980 | Kayahara | 405/269 |
| 4,453,861 | 6/1984 | Bietz et al. | 405/267 |
| 4,467,015 | 11/1981 | Clem | 428/454 |
| 4,501,788 | 9/1982 | Clem | 428/240 |
| 4,534,926 | 8/1985 | Harriett | 405/270 X |
| 4,663,370 | 5/1987 | Maruel, Sr. et al. | 523/221 |
| 4,679,965 | 7/1987 | Gläser et al. | 405/267 X |

OTHER PUBLICATIONS

Civil Engineering, Slurry Trenches for Containing Hazardous Wastes, 02/1984.

Specdata, Waterproofing, 06/1987.

Specdata, Ponds and Reservoirs, 11/1987.

Enviromat/FW, Below-Grade Bentonite Waterproofing, 07/1987.

Enviromat, Liquid Containment Liner, 07/1987.

IMC Corp., Bentonite for Civil Engineering Applications, 08/1983.

*Primary Examiner*—Randolph A. Reese

*Assistant Examiner*—Arlen L. Olsen

*Attorney, Agent, or Firm*—James G. Staples; David I. Roche

[57] ABSTRACT

The invention relates to a barrier for soil structures. The barrier is formed by creating a trench in a soil structure extending from the soil surface to an impervious layer in the soil. The trench is lined with a sheet of impervious material, which may be a fabric carrying a substantially dehydrated sodium-bentonite clay. The trench is especially well-suited for installation around the perimeter of a waste site from which contaminated fluids may be emanating. The barrier and the method of forming the barrier allow a toxic waste site to be easily and completely isolated from adjacent groundwater systems.

12 Claims, 3 Drawing Sheets

15
30
31
21
21a
25
32
33
27
26
22
22a 10
14
21
15
17
16
21a
33
11
20
22
22a
12

Fig. 3.
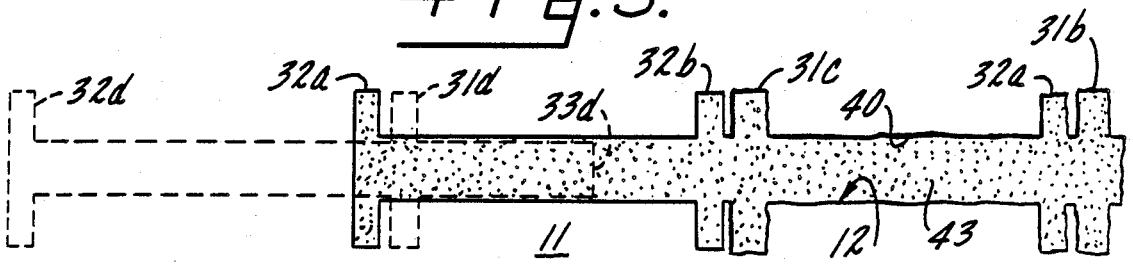
Fig. 4.
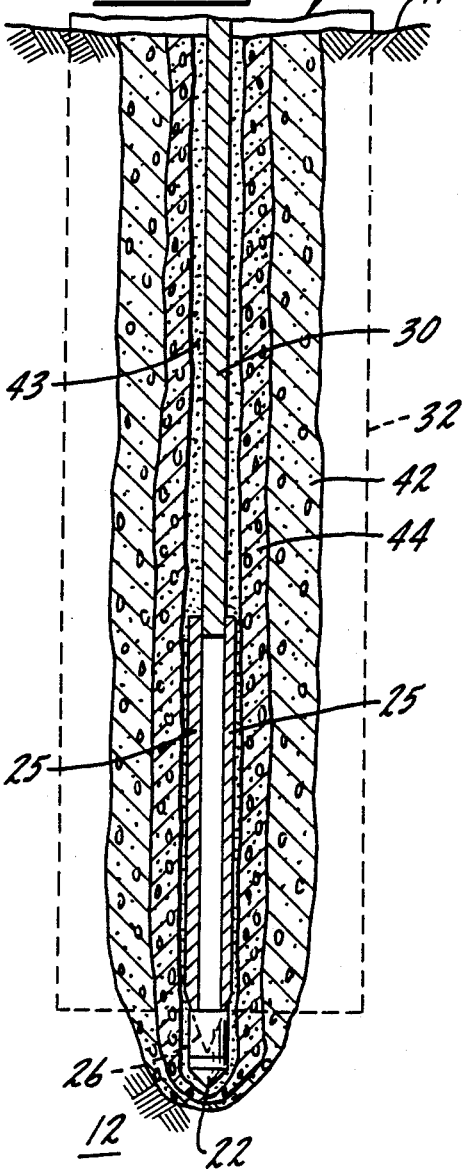
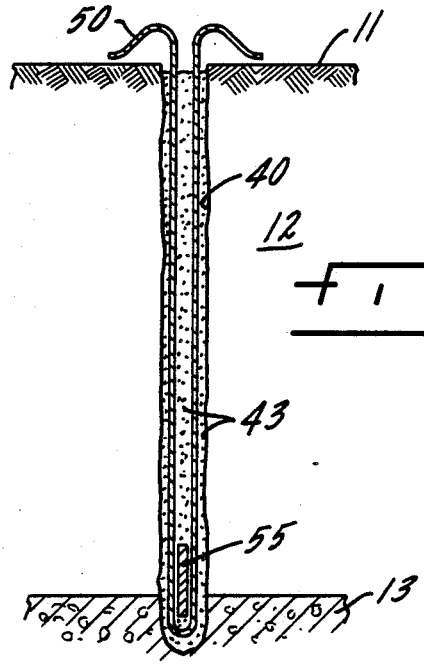
Fig. 8.
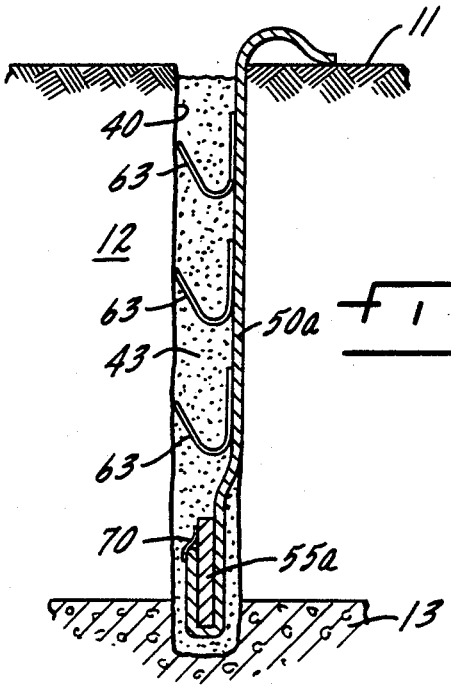
Fig. 9.

LEAK PREVENTION STRUCTURE, METHOD AND APPARATUS

BACKGROUND AND SUMMARY OF THE INVENTION

This invention relates generally to the formation of an impervious layer in a soil structure, and more specifically, to a generally vertically oriented barrier which can be used to isolate a source of contaminated groundwater. The invention is particularly useful in sealing off a contaminated dump site by surrounding the site with a continuous vertical layer of substantially impervious material.

The use of slurry walls to create a subsurface barrier which is vertically oriented is well known. Trenches, which may be formed by any of several means, are filled with a mixture of bentonite clay and water to temporarily support the walls of the trench until concrete is pumped into the trench displacing the slurry. Such subsurface walls rely on the concrete material to prevent the flow of fluids across the trench. However, due to the rigid nature of hardened concrete, and the likelihood that soil adjacent to the concrete will shift with substantial force, such concrete barrier walls are unreliable as a truly impervious barrier to the flow of contaminated groundwater.

Furthermore, it is often difficult to obtain access to areas surrounding an existing contaminated landfill. The prior art techniques of forming a slurry trench and subsequently filling that trench with concrete require substantial surface area in which to operate. In fact, in areas surrounding landfills which have been in existence for several years, the space requirements of prior art techniques make the formation of vertical barrier walls impossible.

A particularly useful form of sheet materia useful in creating a barrier in accordance with the present invention is shown and described in U.S. Pat. No. 4,501,788, and its European counterpart patent No. 0059625, which patents are incorporated herein by reference. The sheet comprises a support coated with a layer of bentonite. The support is a flexible porous fabric capable of venting gas to which the bentonite adheres. The support may be a woven polypropylene mat and the sheet may also have a fabric scrim covering to protect it during transport, handling and installation. A series of sheets can be installed with a minimal overlap to form a barrier of almost any shape.

Accordingly, it is a primary object of the present invention to provide a method for forming an impervious barrier to the flow of contaminated groundwater from existing leaking landfills.

Another object of the invention is to provide an effective barrier against the flow of contaminated groundwater through soil structures which will withstand substantial movement of soil within the structure.

A further object of the invention is to provide an economical and effective apparatus for installing a barrier against the flow of contaminated fluids in a soil structure.

A further object of the invention is to provide a barrier to the flow of contaminated fluids which is substantially less permeable as compared to conventional barrier forming techniques.

Yet another object of the invention is to provide a method and apparatus for installing an impermeable sheet in a slurry filled trench.

Yet another object of the invention is to provide a barrier for use in soil structures which includes sheets of impervious material, the perimeter areas of which form joints against adjacent material which are effective barriers against the flow of contaminated fluid.

These and other objects, features and advantages of the invention will become apparent upon a reading of the following description, read in conjunction with the accompanying drawings.

BRIEF DESCRIPTION OF THE DRAWINGS

FIG. 3 is a plan view of a series of openings formed in a soil structure in accordance with the present invention;

FIG. 4 is a sectional view showing a trench forming tool used to form a trench in a soil structure in accordance with the present invention;

FIG. 8 shows an impervious sheet in place in a trench in accordance with the present invention; and FIG. 9 shows an alternative embodiment of a barrier in accordance with the present invention.

DETAILED DESCRIPTION OF THE INVENTION

Figures 1, 2:
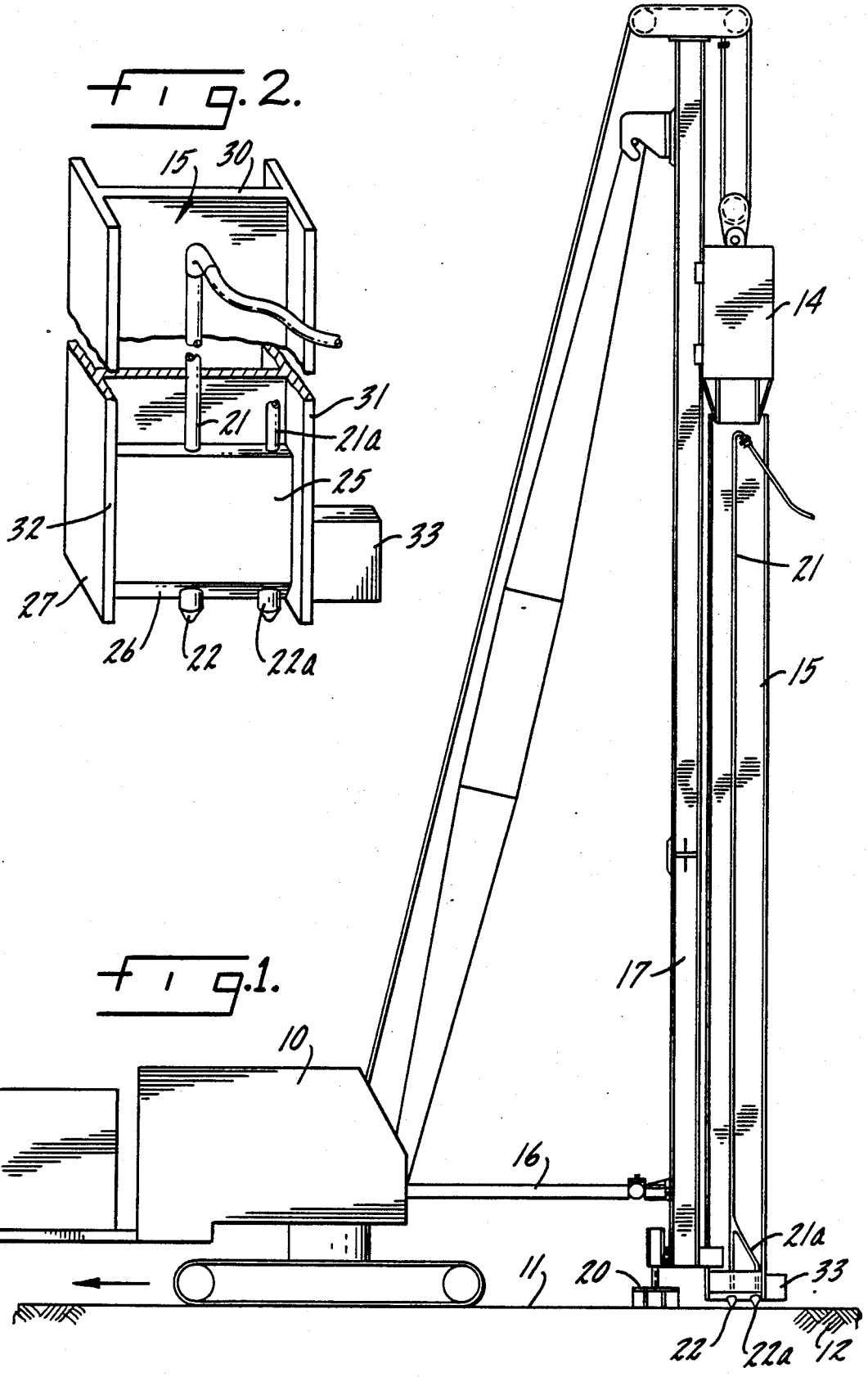
FIG. 1 is a side elevational view of an apparatus used in forming a barrier in accordance with the present invention.
FIG. 2 is a perspective view of the bottom end of a device used in forming a trench in accordance with the present invention.

FIG. 1 shows a crane 10 resting on the surface 11 of the soil structure 12. The crane 10 supports a vibratory hammer 14 which is used to push the modified penetrating beam 15 into the soil structure 12. A spotter 16 attached at one end to the crane 10 is used to position a guide 17 along which the vibratory hammer 14 rides. A guide support 20 stabilizes the guide 17 during the operation of the vibratory hammer 14 and insertion of the beam 15. Operation of the vibratory hammer 14 causes the beam 15 to descend into the soil structure 12 which causes soil around the beam 15 to densify. In addition, the beam 15 is equipped with a slurry injection line 21 which feeds slurry under pressure to nozzles 22 disposed on the lower end of the beam 15.

FIG. 2 shows detailed features of the beam 15. A widened section 25, having a pointed end 26, is formed at the bottom end 27 of the beam 15. The widened section 25 extends along the web 30 between the flanges 31 and 32. Slurry lines 21 and **21*a* extend through the widened section 25 and terminate in nozzles 22 and 22*a*. A fin 33 is carried by the flange 31 and has a thickness corresponding to the thickness of the widened section 25**.

FIG. 3 shows a plan view of a portion of a trench 40, which has been formed by inserting the beam 15 into the soil structure 12. The dotted portion of FIG. 3 corresponds to a cross section of the beam through the bottom end 27. From FIG. 3 it can be seen that the purpose of the fin 33 is to aid in the alignment of the insertion of the beam 15 to ensure that the trench 40 is continuous. FIG. 3 also shows the sequence of successive insertions of the beam 15. The notches 32*a*, 32*b* and 32*c* correspond to successive formations by the flange 32. SImilarly, notches 31*b*, 31*c* and 31*d* correspond to successive formations by the flange 31. The dotted line 33D shows the flange 33 in phantom. It can be understood, therefore, that in successive drivings of the beam 15 the flange 31, which carries the fin 33, overlaps the notch made by the flange 32 in the immediately preceding insertion of the beam. To make the sequence shown in FIG. 3 more clear, the letter following the reference numerals shown in FIG. 3, (a, b, c and d) correspond to successive insertions of the beam.

FIG. 4 is a cross sectional view of the beam 15 with the lower end 27 of the beam inserted into the soil structure 12. As the beam is inserted into the soil structure, soil adjacent to the beam is densified, as shown at 42, by the widened section 25. The pointed end 26 of the beam, together with the vibratory hammer 14 and the weight of the beam 15, cause the beam to descend into the soil structure. During the insertion of the beam, a bentonite slurry is fed through the nozzles 22 to further assist in the penetration process. Therefore, soil immediately adjacent to the beam is saturated with the bentonite and water mixture 43. The saturated soil 44 is compacted to an even greater extent than is the densified soil 42.

Figures 5, 6, 7:
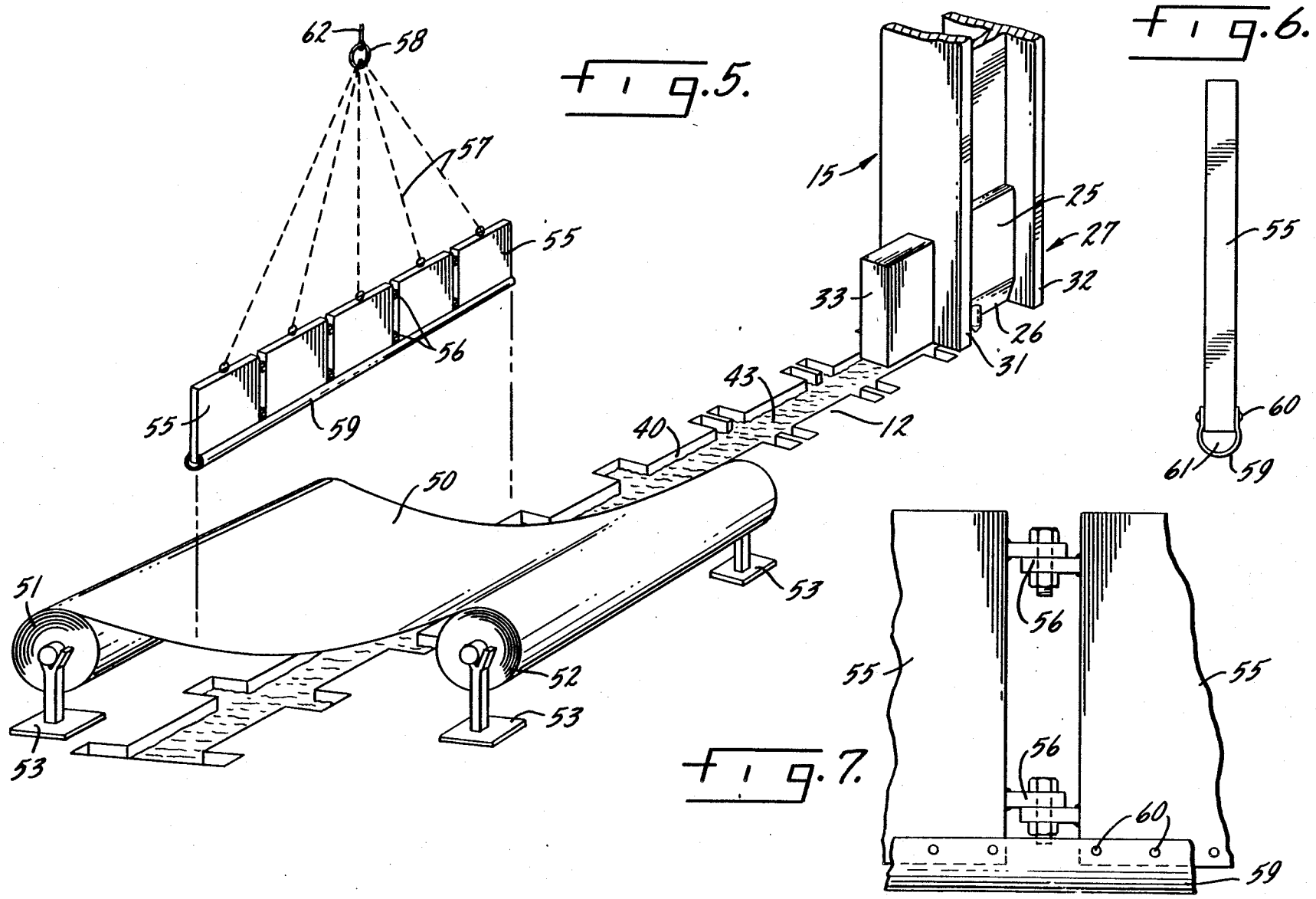
FIG. 5 is a perspective view which shows a roll of impervious sheet material, a lowering device, and a trench forming device.
FIG. 6 is an end elevational view of the lowering device shown in FIG. 5.
FIG. 7 is a side elevational view showing a hinge arrangement of the lowering device shown in FIG. 5.

FIG. 5 shows the second major step involved in the utilization of the present invention. After a length of trench has been formed by the method described above, a sheet of impervious material, preferably a bentonite clay carried by a flexible fabric carrier, is positioned over a portion of the trench. In FIG. 5 a pair of rolls 51 and 52 of the sheet 50 are supported on stands 53. A series of weights 55, which are individually supported by cables 57, are lifted into a position over the sheet 50 and are generally aligned with the trench. The weights 55 are connected to one another by hinges 56. Along the bottoms of the weights 55 a continuous length of flexible rubber 59 has been attached to prevent damage to the sheet 50. As can be seen in FIGS. 6 and 7, the rubber 59 is attached to the weights 55 by fasteners 60. A space 61 between the rubber and the bottom of the weight 55 forms a cushion so that when the weight is lowered against the sheet 50 a gentle pushing action will occur. The weights 55 and the cables 57 are joined together at coupling 58, which is suspended by a cable 62 leading back to the crane 10. The weights 55 push the sheet 50 into the trench so that opposing walls of the trench are aligned with the sheet material.

FIG. 8 shows a typical cross section in which a double thickness of sheet 50 has been used. The sheet extends the full length of the trench from the surface 11 down to a bedrock layer 13. As the sheet 50 is pushed into the trench, slurry 43 flows into the area between the walls of the trench on both sides of the sheet 50.

FIG. 9 shows an alternative method of lining the wall of the trench with a sheet. In FIG. 9, the sheet 50*a* is attached to weight 55*a* by fasteners 70. The sheet 50*a* can be in a roll similar to roll 51 or roll 52. As shown in the embodiment of FIG. 8, it is important for the sheet 50*a* to extend completely from the surface 11 to the bedrock 13. Resilient spreading elements 63 are inserted into the trench 40 between one of the sidewalls of the trench and the sheet 50*a*. The weight 55*a* may be retrieved from the trench for re-use, or may be left at the bottom of the trench.

Formation of a barrier in accordance with the present invention is made as follows. A trench is formed by suitable means. The vibratory hammer and beam technique described herein is an example. However, a method whereby soil is excavated to form a trench may be used. As the trench is formed it may or may not be necessary to support the side walls of the trench with a slurry. Once a trench has been formed and its side walls stabilized, a sheet of impervious material is lowered into the trench. The sheet may be of any suitable low-permeability material, but preferably, it is a clay-based sheet including a flexible carrier which enables the clay to be handled in rolls. The carrier may be a pervious or impervious material. If an extended trench is required, several sheets will need to be inserted into the trench. Adjacent sheets should overlap to some extent. It has been found that an overlap of approximately 12 inches in the case of a clay-based fabric is sufficient. Spreading elements can be used at the location of the overlap to ensure a continuous lining of at least one wall of the trench. Once at least one wall is lined, and the sheet is pressed into engagement with a wall of the trench, it may be desirable, particularly when a slurry has not been used, to fill the remaining volume of the trench with a concrete or other suitable fill material. When a slurry has been used, it may still be desirable to displace the slurry material with a concrete wall.

Depending on the type of soil encountered at the site, the use of a vibratory hammer may be advantageous because the vibration will tend to densify soil in the area of the trench making the soil in this location less permeable. In addition, there may be an advantage to using a hardenable fluid, such as bentonite slurry, a mixture of bentonite and cement and/or fly ash, and a polymerized asphalt emulsion, injected at the end of the beam driven by the vibratory hammer because injection at that location will facilitate insertion of the beam, cause densification of adjacent soil, and thereby, further enhance the impermeability of the soil structure. Thus, such a technique will provide three factors tending to provide a barrier against the flow of contaminated groundwater, namely, densification, the presence of a hardenable material in the densified soil, and an impervious clay-based sheet extending from the surface to a rock layer.

It should be noted that the depth of the trench may not need to extend to a bedrock layer. In some soil structures, layers of soil which are sufficiently impervious can provide a base upon which the barrier can be built.

The invention has been described above with reference to specific embodiments. It is anticipated that numerous alternatives, variations and modifications of the invention will occur to those skilled in the art. Accordingly, it is intended that the scope of the invention be limited not by the above described embodiments, but rather by the scope of the following claims interpreted in light of the pertinent prior art.

We claim:

1. A method of forming an in-situ sub-surface barrier to contaminated groundwater or other undesired groundwater flow in a soil structure comprising the steps of:

forming a trench in said soil structure, said trench having a depth substantially greater than its width, inserting into said trench a plurality of clay based sheets by, positioning at least one flexible sheet of clay based material by said trench with a portion of said material extending over said trench, wherein each sheet having a low coefficient of permeability upon hydration thereof, placing a weight on said portion, and pushing said flexible sheet of clay based material into said trench, lining at least one side of said trench with said sheets, and overlapping edges of adjacent sheets so that clay of one of said sheets contacts an adjacent sheet to form an impermeable joint, whereby a continuous internally extending impermeable barrier is formed with a plurality of adjacent sheets.

2. A method of forming a barrier to fluid flow in a soil structure in accordance with claim 1 wherein said method includes:

filling said trench with a hardenable fluid.

3. A method of forming a barrier to fluid flow in a soil structure in accordance with claim 2 wherein said fluid is selected from:

bentonite slurry, a cement and bentonite mixture, a polymerized asphalt emulsion, or a cement (fly ash) bentonite mixture.

4. A method of forming a barrier to fluid flow in a soil structure in accordance with claim 1 wherein:

said sheet is fed into said trench from a roll.

5. A method of forming a barrier to fluid flow in a soil structure in accordance with claim 1 wherein:

fill is concrete pumped into said trench after lining said trench with said sheet.

6. A method of forming a barrier to fluid flow in a soil structure in accordance with claim 1 wherein said forming of said trench includes the steps of:

using a vibratable, vertical, elongated member to spread and compact soil in a vertical zone to form a portion of said trench, and injecting a hardenable material into said portions during insertion and withdrawal of said elongated member.

7. A method of forming a barrier to the flow of contaminated fluid from containment areas such as waste storage sites, landfills, and the like, in accordance with claim 1 wherein:

said trench is formed by using a vibrated tool without excavating soil from said soil structure.

8. A method of forming a barrier to the flow of contaminated fluid from containment areas such as waste storage sites, landfills, and the like, said method comprising:

forming a trench in a soil structure such that waste material is at least partially circumscribed, said trench having a depth extending to a substantially impermeable layer in said soil structure, said trench having a depth substantially greater than its width, inserting into said trench a series of adjacent flexible sheets of clay-based barrier material by, positioning at least one flexible sheet of clay based material by said trench with a portion of said material extending over said trench, wherein said material being substantially impermeable upon exposure to water, placing a weight on said portion, and pushing said flexible sheet of clay based material into said trench, overlapping adjacent edges of said sheets such that clay of some of said edges contacts the other of said edges whereby such series of sheets forms a longitudinally continuous barrier to the flow of contaminated fluids across said trench.

9. A method of forming a barrier to the flow of contaminated fluid from containment areas in accordance with claim 8 wherein:

said trench is formed without excavation by repeatedly inserting a beam into said soil structure, said beam having nozzles at the lower end of said beam, slurry being injected through said nozzles into said trench, insertion of said beam being facilitated by a vibratory hammer.

10. A method of forming a barrier to the flow of contaminated fluid from containment areas in accordance with claim 8 wherein:

each of said flexible sheets is fed from a roll and pushed into said trench with removable weights, whereby the contents of said trench consist essentially of slurry and said barrier material.

11. A method of forming a barrier to the flow of contaminated fluid from containment areas in accordance with claim 10 wherein:

said slurry is replaced with a hardenable material, whereby the contents of said trench consist essentially of said hardenable material and said barrier material.

12. A method of forming a barrier to the flow of contaminated fluid from containment areas such as waste storage sites, landfills, and the like, in accordance with claim 8 wherein:

said trench is formed by using a vibrating tool without excavating soil from said soil structure.

* * * * *